United States Patent [19]

Goralnik

[11] 4,303,968

[45] Dec. 1, 1981

[54] MOUNTING ASSEMBLY FOR A CHANDELIER-TYPE LIGHT FIXTURE

[76] Inventor: Charles D. Goralnik, 200 Brynwyck Pl., St. Louis County, Mo. 63141

[21] Appl. No.: 103,239

[22] Filed: Dec. 13, 1979

[51] Int. Cl.[3] ..... F21S 1/02

[52] U.S. Cl. ..... 362/147; 362/396; 362/404

[58] Field of Search ..... 362/147, 396, 404

[56] References Cited

U.S. PATENT DOCUMENTS 2,914,661 11/1959 Winkler ..... 362/404

*Primary Examiner*—Stephen J. Lechert, Jr.

*Attorney, Agent, or Firm*—Senniger, Powers, Leavitt and Roedel

[57] ABSTRACT

A mounting assembly for a chandelier-type light fixture to be suspended by a chain or the like from a ceiling. The mounting assembly comprises an outlet box open at its bottom adapted to be mounted in an opening in the ceiling, and a crossbar extending beneath the bottom of the outlet box, the ends thereof extending beyond the sides of the outlet box for engagement with the ceiling. Fasteners interconnect the crossbar and the outlet box, the fasteners being capable of developing a clamping force for holding the crossbar in spaced relation relative to the outlet box clamped against the ceiling. A support extends down from the crossbar and has a head at its lower end adapted to be engaged by and to support the chain, the bottom of the head being at a predetermined distance below the crossbar. A canopy is provided beneath the outlet box for covering the bottom thereof, and a ring is provided for releasably securing the canopy to the head of the support. The height of the canopy is less than said predetermined distance so that, with the canopy secured to the head of the support, the upper edge of the canopy engages the ceiling.

15 Claims, 5 Drawing Figures

MOUNTING ASSEMBLY FOR A CHANDELIER-TYPE LIGHT FIXTURE

BACKGROUND OF THE INVENTION

This invention relates to mounting assemblies for a chandelier-type light fixture to be suspended by suspending means such as a chain or the like from a ceiling.

Prior art mounting assemblies of this type generally comprise an outlet box open at its bottom adapted to be mounted in an opening in the ceiling, a crossbar secured to the outlet box at the bottom thereof with its ends inwardly adjacent the sides of the outlet box, and a support such as an eye-bolt having a threaded shank and an externally threaded head, the shank being received in threaded engagement in a tapped hole in the crossbar. A canopy for covering the outlet box is adapted to be secured against the ceiling by a retaining ring threaded on the head, with the upper edge of the canopy engaging the ceiling when the retaining ring is threaded on the head, so that the mounting assembly is rigidly secured within the opening in the ceiling and presents a finished appearance.

Although such mounting assemblies provide a satisfactory construction once installed, their installation can be difficult. Because the outlet box of these prior art mounting assemblies may be mounted within the opening in the ceiling at various elevations relative to the ceiling level, the support may have to be rotated to elevate its head to the appropriate position below the ceiling for supporting the canopy in engagement with the ceiling, after the light fixture has already been suspended from the support and the wiring completed. Such rotation is cumbersome, particularly when a large light fixture is suspended from the support, and results in twisting the wiring.

SUMMARY OF THE INVENTION

Among the several objects of the present invention is the provision of a mounting assembly for a chandelier-type light fixture which enables the canopy to be secured with its upper edge in engagement with the ceiling while the light fixture is suspended from the assembly, without rotating or otherwise moving the light fixture; the provision of such a mounting assembly which eliminates the need to adjust the elevation of the head of the support for the light fixture relative to the ceiling after the outlet box and crossbar has been mounted in a ceiling; the provision of such a mounting assembly which may be easily and quickly mounted within an opening in a ceiling, with the mounting assembly presenting a finished appearance upon installation; and the provision of such a mounting assembly to which suspending means, such as a chain, for a chandelier-type light fixture may be easily and quickly secured.

In general, a mounting assembly of this invention is of the aforementioned type and comprises an outlet box open at its bottom adapted to be mounted in an opening in the ceiling, and a crossbar extending beneath the bottom of the outlet box, the ends of the crossbar projecting beyond the sides of the outlet box for engagement with the ceiling. Means interconnecting the crossbar and the outlet box are provided, the interconnecting means being adjustable for varying the elevation of the crossbar relative to the outlet box and capable of developing a clamping force for holding the crossbar clamped against the ceiling in spaced relation relative to the outlet box. A support extends down from the crossbar having a head at its lower end adapted to be engaged by and to support the suspending means for the light fixture, the bottom of the head being at a predetermined distance below the crossbar. A canopy is provided beneath the outlet box for covering the bottom thereof, the canopy having an upper edge toward the outlet box, a bottom away from the outlet box, and an opening extending through the bottom, the head of the support and the suspending means being adapted to extend through the opening. Means below the canopy releasably secures the canopy to the head of the support. The height of the canopy constituted by the distance between the upper edge of the canopy and its bottom is less than said predetermined distance so that, with the canopy secured to the head of the support, the upper edge of the canopy engages the ceiling.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 2:
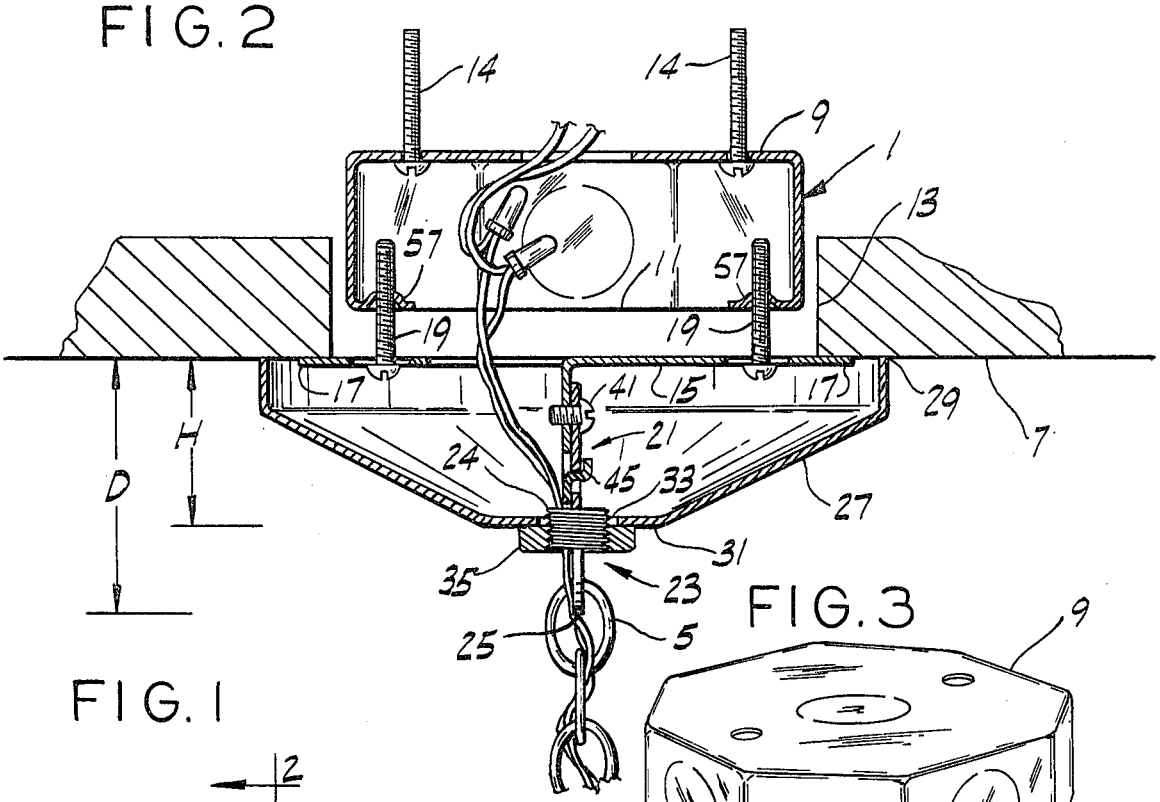
FIG. 2 is a vertical section of the mounting assembly taken on line 2—2 of FIG. 1.
Figure 1:
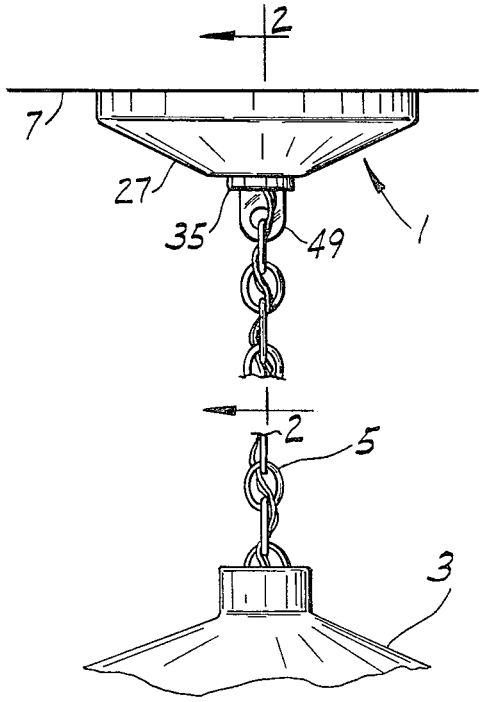
FIG. 1 is an elevation of the mounting assembly of this invention mounted in an opening in a ceiling with its canopy in engagement with the ceiling.
Figure 3:
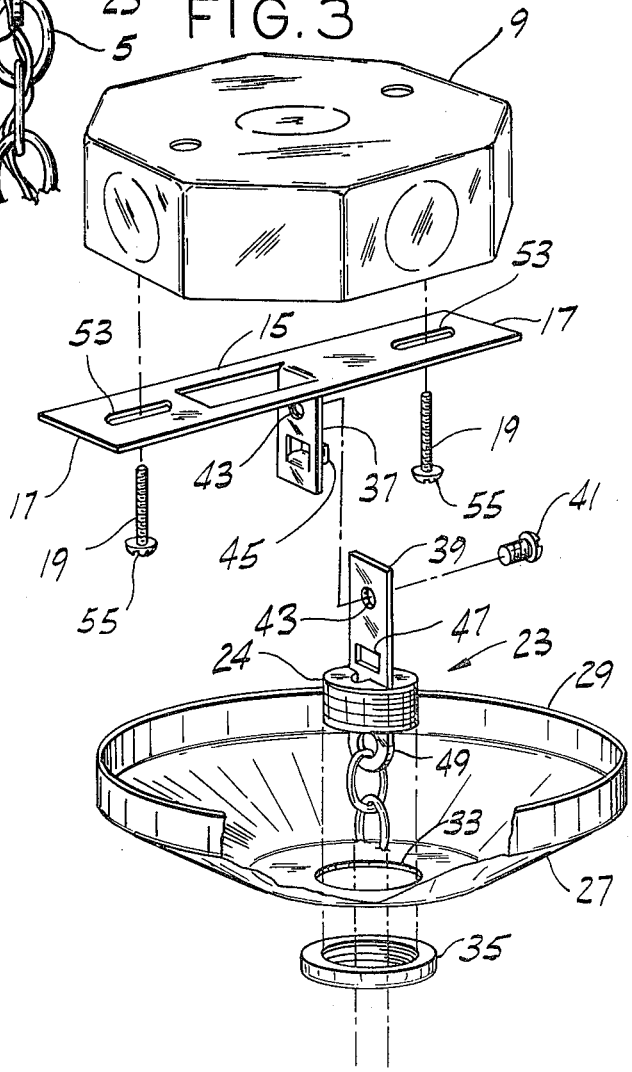
FIG. 3 is an exploded perspective view of the mounting assembly.

Referring to the drawings, particularly to FIGS. 1 and 2, there is generally indicated at 1 a mounting assembly of this invention for a chandelier-type light fixture 3 to be suspended by suspending means such as chain 5 or the like from a ceiling 7. The mounting assembly 1 comprises a standard junction or outlet box 9 open at its bottom 11 adapted to be mounted in an opening 13 in the ceiling 7 by conventional fastening means such as screws 14 extending through an opening in the top of the outlet box. A crossbar 15 extends beneath the bottom of the outlet box, the ends 17 of the crossbar projecting beyond the sides of the outlet box for engagement with the ceiling 7. Means, such as screws 19, interconnect the crossbar 15 and the outlet box, the screws enabling the elevation of the crossbar to be varied relative to the outlet box and being capable of developing a clamping force for holding the crossbar 15 clamped against the ceiling in spaced relation to the outlet box. A support 21 extends down from the crossbar and has a head 23 at its lower end adapted to be engaged by and to support the chain 5 and having an externally threaded cylindrical portion 24 oriented on a vertical axis. The bottom 25 of the head is at a predetermined distance D below the upper surface of the crossbar. A canopy 27 is provided beneath the outlet box for covering its open bottom 11, the canopy having an upper edge 29 toward the outlet box, a bottom 31 away from the outlet box and an opening 33 extending through the bottom, the head 23 of the support and the chain 5 being adapted to extend through the opening.

The mounting assembly 1 further comprises means such as an internally threaded retaining ring 35 engageable with threaded portion 24, and having an external diameter greater than opening 33, for releasably supporting the canopy 27 on the head of the support. Height H of the canopy constituted by the distance between the upper edge 29 of the canopy and its bottom 31 is less than said predetermined distance D so that, by adjusting the position of the canopy by turning ring 35, the upper edge 29 of the canopy engages the ceiling. The support comprises a first support member such as a tongue 37 struck from the crossbar 15, a second support member such as shank 39 extending up from the head 23, and means 41 for releasably securing the tongue and the shank together comprising a screw 41 being received in holes 43 in the tongue and the shank, and a finger 45 having an upwardly extending lip at the end thereof. For certain applications of the mounting assembly, the finger 45 alone may be adequate for securing the tongue and shank together. In other applications, particularly for heavy light fixtures and for inclined ceilings, both the finger 45 and the screw 41 should be used, the screw and finger cooperating to prevent pivotal, as well as, axial movement of the shank relative to the tongue. One of the holes 43 for the screw 41 may be tapped so as to receive the screw 41 in threaded engagement or, alternately, a nut (not shown) engageable by the screw 41 may be provided so that upon tightening the screw, the tongue and the shank are held in face-to-face engagement as shown in FIG. 2. Because of the two-piece construction of support 21, the chain 5 may be secured to the head 23 before the lighting fixture 3 is lifted into mounting position.

Head 23 of the support comprises threaded portion 24 and an eye 49 adapted to receive a link of the chain 5. The height H of the canopy is slightly less than the distance between the bottom of the threaded portion and the upper surface of the crossbar, as shown in FIG. 2, so that the threaded portion 24 extends below the bottom 31 of the canopy 27 and may be engaged by the retaining ring 35 for supporting the canopy 27 thereon.

Upon tightening the retaining ring 35 against the bottom 31 of the canopy, the upper edge 29 of the canopy engages the ceiling, the mounting assembly thus presenting a finished appearance. Moreover, the tightening of the ring 35 results in developing a tension force in the support 21 and a compression force on canopy 27 for rigidly securing the mounting assembly against the ceiling. As illustrated in FIG. 2, the top of the threaded portion 24 preferably extends above the bottom of the canopy (i.e., the height H of canopy is greater than the distance between the top of the threaded portion 24 and the upper surface of the crossbar) for positioning the opening 33 of the canopy horizontally relative to the bottom 11 of the outlet box so that the canopy will cover the opening 13 in the ceiling.

The crossbar 15 comprises a flat, relatively narrow strip of metal, the tongue 37 being struck therefrom so as to extend downwardly from a central portion of the crossbar. The length of the crossbar 15 is greater than the width of the outlet box 9 so that the ends 17 of the crossbar extend beyond the outlet box, the ends being engageable with the ceiling 7. Inwardly adjacent each end 17 of the crossbar is an elongate slot 53 adapted to receive one of the screws 19. Each screw has a head 55 engageable with the lower side of the crossbar, and extends up through one of the elongate slots 53 into engagement with a tapped hole in one of two horizontal tabs 57 projecting inwardly toward each other from opposite sides of the outlet box. Preferably, the screws 19 are approximately as long as the height of the outlet box 9. With the outlet box 9 mounted in an opening 13 in the ceiling, the screws 19 may be adjusted to move the crossbar 15 relative to the outlet box to an elevation where the ends 17 of the crossbar engage the ceiling and a clamping force is developed for holding the crossbar against the ceiling in spaced relation to the outlet box.

In the use of the mounting assembly 1 to suspend a light fixture 3 from a ceiling, the outlet box 9 is secured in an opening 13 in the ceiling 7 by screws 14 or other suitable securing means (not shown), the depth at which the outlet box is recessed within the opening varying from instance to instance. The crossbar 15 is connected to the outlet box below the ceiling by screws 19, the screws being adjusted to bring the crossbar into engagement with the ceiling and develop a clamping force holding the crossbar 15 against the ceiling. Prior to the light fixture 3 being lifted up toward the mounting assembly 1, the retaining ring 35 and the canopy 27 are slid onto the chain 5, and a link of the chain is attached to the eye 49 of support 21 by opening the link and then closing it around the eye. The light fixture 3 is then lifted, and the shank 39 of the support brought into engagement with the tongue 37. With the finger 45 carrying the weight of the light fixture, the screw 41 is placed in the holes 43 and tightened to secure the tongue and shank together. The wiring in the outlet box is completed and the canopy is slid up the chain until its upper edge 29 engages the ceiling to cover the opening 13 in the ceiling. Lastly, the retaining ring 35 is slid up the chain and threaded onto the threaded portion 51 of the head 23 until the ring engages the bottom 31 of the canopy and urges the upper edge 29 of the canopy against the ceiling.

Figure 4:
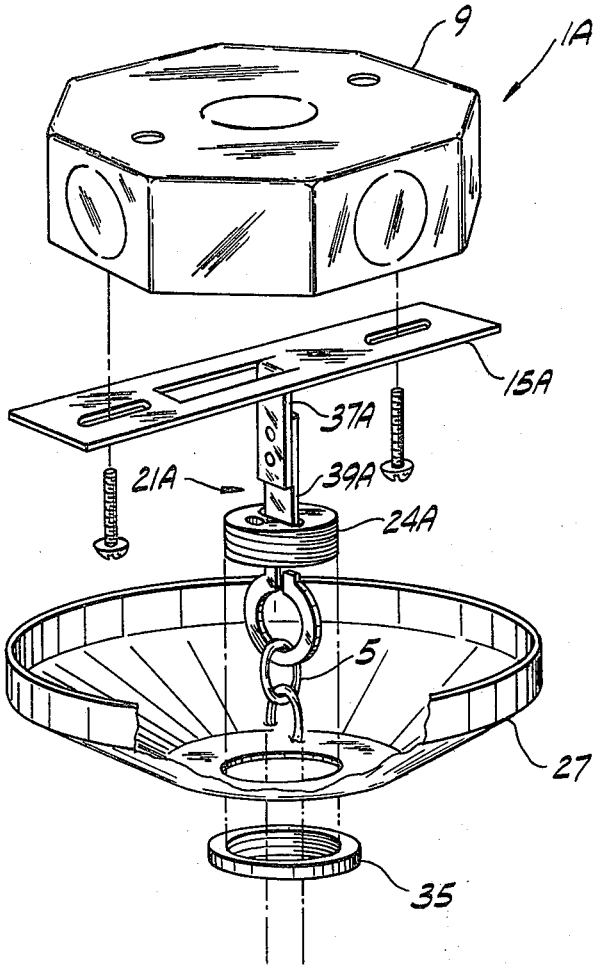
FIG. 4 is an exploded perspective view of an alternative embodiment of the mounting assembly.
Figure 5:
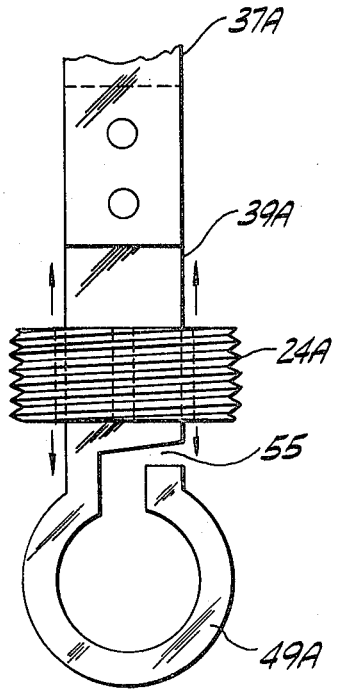
FIG. 5 is an enlarged side elevation of the support of the alternative embodiment of the mounting assembly.

An alternative embodiment of the mounting assembly 1A as shown in FIGS. 4 and 5 is similar to the above described mounting assembly 1, except that the first and second support members (i.e., tongue 37A and shank 39A) are secured together by spot welding or other suitable means, the threaded portion 24A of the head of the support 21A is slidably mounted on the second support member for movement between lowered and raised positions, and the second member has a slot 55 extending upwardly and outwardly from the eye 49A to the side of the shank. The threaded portion 24A covers the slot 55 and is adapted to be engaged by the ring 35 when in lowered position, and uncovers the slot when in raised position for enabling the chain 5 to be passed through the slot and to be received in the eye 49A. The installation of the alternative mounting assembly 1A involves connecting the crossbar 15A to the outlet box secured in the ceiling, attaching the chain 5 to the eye 49A of the support 21A, and threading the ring 35 onto the threaded portion 24A of the head in its lowered position to clamp the canopy 27 against the ceiling.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mounting assembly for a chandelier-type light fixture to be suspended by suspending means such as a chain or the like from a ceiling, said assembly comprising:

an outlet box open at its bottom adapted to be mounted in an opening in the ceiling;

a crossbar extending beneath the bottom of the outlet box, the ends of the crossbar projecting beyond the sides of the outlet box for engagement with the ceiling;

means interconnecting the crossbar and the outlet box, said interconnecting means being adjustable for varying the elevation of the crossbar relative to the outlet box and capable of developing a clamping force for holding the crossbar clamped against the ceiling in spaced relation to the outlet box;

a support extending down from the crossbar having a head at its lower end adapted to be engaged by and to support the suspending means, the bottom of the head being at a predetermined distance below the upper surface of the crossbar;

a canopy beneath the outlet box covering the bottom thereof having an upper edge toward the outlet box, a bottom away from the outlet box and an opening extending through the bottom, the head of the support and the suspending means being adapted to extend through said opening; and means for releasably securing the canopy to the head of the support, said securing means being adapted to be carried on the head of the support and engageable with the bottom of the canopy, the height of the canopy constituted by the distance between the upper edge of the canopy and its bottom being less than said predetermined distance so that, with the canopy secured to the head of the support, the upper edge of the canopy engages the ceiling.

2. A mounting assembly as set forth in claim 1 wherein said head of the support comprises a portion engageable by said means for releasably securing the canopy to the head of the support, and wherein with the securing means engaging the head, the height of the canopy is less than the distance between the bottom of said portion of the head and the upper surface of the crossbar.

3. A mounting assembly as set forth in claim 2 wherein the height of the canopy is greater than the distance between the top of said portion of the head and the crossbar, so that said portion of the head of the support is adapted to extend within the opening in the canopy for positioning the opening of the canopy relative to the bottom of the outlet box.

4. A mounting assembly as set forth in claim 3 wherein said portion of the head is threaded, and wherein the means for releasably securing the canopy to the head comprises a ring the interior surface of which is threaded, the external diameter of the ring being greater than the diameter of the opening in the canopy.

5. A mounting assembly as set forth in claim 4 wherein the head of the support has an eye adapted to receive the suspending means.

6. A mounting assembly as set forth in claim 5 wherein the support comprises a support member extending up from the eye in the head, and wherein the threaded portion of the head is slidably mounted on the support member for movement therealong between lowered and raised positions, the support member having a slot extending upwardly and outwardly from the eye to the side of the support member, said threaded portion covering the slot and being adapted to be engaged by the ring when in lowered position, and uncovering the slot for enabling the suspending means to be received in the eye when in raised position.

7. A mounting assembly as set forth in claim 1 wherein the support comprises a first support member extending down from the crossbar, a second support member extending up from said head of the support, and means for securing the support members together.

8. A mounting assembly as set forth in claim 7 wherein the means for securing the support members together comprises a finger extending outwardly from one of said support members adapted to be received in an opening in the other of said support members.

9. A mounting assembly as set forth in claim 8 wherein said means for releasably securing the support members together further comprises a screw extending through holes in said support members, the screw being adapted to hold said support members in engagement.

10. A mounting assembly as set forth in claim 7 wherein the first support member comprises a tongue struck from the crossbar.

11. A mounting assembly as set forth in claim 1 wherein the interconnecting means comprises a pair of screws each adapted to extend through an opening in the crossbar into engagement with a tapped hole in the outlet box, each of the screws being a head engageable with the lower side of the crossbar and being approximately as long as the height of the outlet box.

12. A mounting assembly for a chandelier-type light fixture to be suspended by suspending means such as a chain or the like from a ceiling, said assembly comprising:

an outlet box open at its bottom adapted to be mounted in an opening in the ceiling;

a support extending down from the outlet box comprising a head at the lower end thereof having an eye adapted to receive the suspending means, and an opening extending from the eye to the side of the support, a portion of the head being movable toward and away from a position on the support in which said portion blocks movement of the suspending means through the opening in the support to hold the suspending means in the eye, said portion when moved from said position unblocking the opening for enabling insertion of the suspending means into the eye and removal therefrom;

a canopy beneath the outlet box covering the bottom thereof having an upper edge toward the outlet box, a bottom away from the outlet box and an opening extending through the bottom, the head of the support and the suspending means being adapted to extend through the opening in the bottom of the canopy; and means engageable with the bottom of the canopy for releasably securing the canopy to said portion of the head when in said position, the canopy being held in engagement with the ceiling by said securing means.

13. A mounting assembly as set forth in claim 12 wherein said portion of the head is threaded, and wherein the means for releasably securing the canopy to said portion comprises an internally threaded ring, the outside diameter of the ring being greater than the diameter of the opening in the bottom of the canopy.

14. A mounting assembly as set forth in claim 12 wherein said portion of the head has a longitudinal hole therein adapted to receive electrical wiring extending between the outlet box and the light fixture carried on the suspending means.

15. A mounting assembly as set forth in claim 12 wherein said portion of the head has a longitudinal slot therein, the support comprising a support member extending through said slot, the head being in sliding engagement with the support member.

* * * * *